United States Patent [19]

Reeder

[11] 3,986,762

[45] Oct. 19, 1976

[54] ELECTRICAL CONDUCTOR CONNECTION DEVICE

[75] Inventor: Larry Russell Reeder, San Jose, Calif.

[73] Assignee: Raychem Corporation, Menlo Park, Calif.

[22] Filed: Dec. 18, 1974

[21] Appl. No.: 533,765

[52] U.S. Cl. ..... 339/32 R

[51] Int. Cl.[2] ..... H01R 27/00

[58] Field of Search ..... 339/32 R, 32 M, 33, 339/153, 154 R, 154 A, 177 R, 177 E, 47 R, 49 R

[56] References Cited

UNITED STATES PATENTS

| | | | |
|---|---|---|---|
| 1,628,399 | 5/1927 | Frankel | 339/33 |
| 1,635,056 | 7/1927 | Paiste | 339/33 |
| 2,572,448 | 10/1951 | Child | 339/49 R |
| 2,745,076 | 5/1956 | Kolstad | 339/47 R |
| 3,208,027 | 9/1965 | Johnson | 339/32 R X |
| 3,413,591 | 11/1968 | Hergenhan | 339/33 |
| 3,541,495 | 11/1970 | Ellis et al. | 339/177 E |

*Primary Examiner*—Joseph H. McGlynn
*Assistant Examiner*—Howard N. Goldberg
*Attorney, Agent, or Firm*—Lyon & Lyon

[57] ABSTRACT

A device for connecting electrical conductors comprising a receptacle and plug, the receptacle and plug being adapted such that they may form a straight or right angle connection, the straight connection being either fully shielded or providing test probe access.

26 Claims, 18 Drawing Figures

ELECTRICAL CONDUCTOR CONNECTION DEVICE

BACKGROUND OF THE INVENTION

Numerous coupling devices have been provided for the connecting of electrical conductors such as coaxial cables, twisted conductor pairs and other multiconductor transmission lines, both shielded and unshielded. Generally, these couplings or connectors consist of two interconnectable halves, each half being permanently attached to a cable or transmission line.

The bulk of the following remarks pertain and refer to coaxial cable connectors, however such a description is similar to that of prior art shielded and unshielded multiconductor cable connectors. Coaxial connectors are typically either "straight" or "right angle" connectors. In the case of the straight connector, the connector contacts are mated together in a straight in-line direction. The right angle connector is used when it is desired to turn the coaxial cables in a 90° turn at the point where the two halves of the connector are coupled. Such right angle connectors generally utilize one of the connector halves in the form of a 90° elbow, such that the 90° turn is made entirely within that connector half.

The physical differences between the two connector assemblies require the purchasing and storing of ample numbers of each type. Furthermore, a cable once terminated to a "straight angle" connector half cannot be coupled to another cable such that a "straight" coupling results. Furthermore, the right angle connector halves are far more complex and costly than the straight connectors. This complexity is due to the fact that the inner and outer conductive elements must concurrently turn at right angles, the electrical isolation between the conductive elements being held constant. These complex requirements inevitably result in a more costly connector construction, and increase the likelihood of connector malfunction. As a corollary of the complexity of traditional right angle connector construction, the terminating of the coaxial cable to the right angle connector half, and the coupling of the right angle connector, are generally more difficult as compared with a straight connector. Additionally, the electrical connection produced by such traditional connectors may be difficult to test as the inner connection is generally fully shielded. Such a limitation is primarily a problem of straight connectors, due to the greater frequency of use of such connectors.

SUMMARY OF THE INVENTION

According to the present invention, a device is provided for connecting electrical conductors. the device comprises a connector receptacle and plug. The connector receptacle has a receptacle outer conductor body forming a receptacle passageway therein, the receptacle body having first and second receptacle body mating openings therein communicating with said receptacle passageway. the first and second receptacle body mating openings may be of substantially the same size, lie in perpendicular planes, have perpendicular center lines and may be substantially tangent to each other. At least one inner receptacle conductor element is positioned within the receptacle body passageway, the inner receptacle conductor or conductors being separated from said receptacle body by a dielectric (when more than one inner conductor is utilized, the inner conductors are also insulated from each other by the dielectric) and communicating with the first and second receptacle body mating openings.

The connector plug has a plug outer conductor body forming a plug passageway therein, the plug body having first and second plug body mating openings therein communicating with the plug passageway. The first and second plug body mating openings may be smaller than the first and second receptacle body mating openings, lie in perpendicular planes have perpendicular center lines and may be substantially tangent to each other. The plug body adjacent to and defining the plug body mating openings may be slightly smaller than, and of a shape substantially similar to, the receptacle body mating openings. At least one inner plug conductor element is positioned within the plug body passageway, the inner plug conductor or conductors being separated from the plug body by a dielectric (when more than one inner conductor is utilized, the inner conductors are also insulated form each other by the dielectric) the inner plug conductor communicating with the first and second plug body mating openings.

DESCRIPTION OF THE INVENTION

Figure 1:
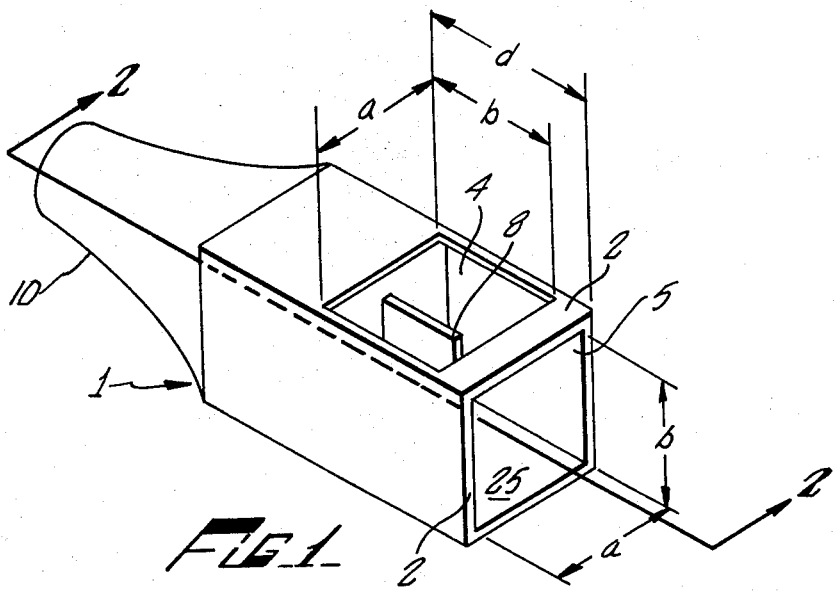
FIG. 1 is a perspective view of a connector receptacle before it has been terminated to a cable or wire.
Figure 2:
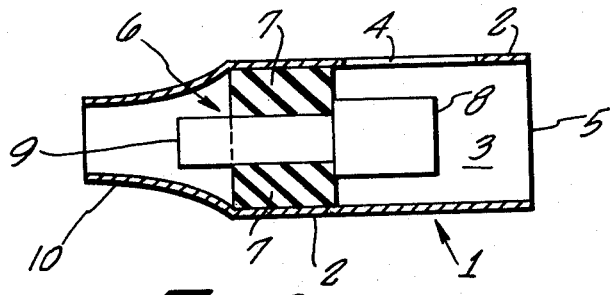
FIG. 2 is a cross-section view taken along lines 2—2 of FIG. 1.

Referring now to FIGS. 1–4, a connector receptacle 1 is shown having a receptacle outer conductor body 2 forming a receptacle passage 3 therein. The receptacle body 1 being provided with a first receptacle body mating opening 4 and a second receptacle body mating opening 5, both mating openings 4 and 5 being in communication with the receptacle passage 3. The mating openings 4 and 5 being approximately the same size and shape, lying in perpendicular planes and having perpendicular center lines. In a preferred embodiment as shown in FIG. 1, mating openings 4 and 5 are rectangular having rectangle legs *a* and *b*, the *b* dimension of the opening 5 defining the depth of the opening 4, and the *d* dimension defining the depth of the opening 5.

Located within the receptacle body 2 is a receptacle inner conductor element 6 which is separated from the receptacle body 2 by a dielectric 7. In a preferred embodiment the receptacle conductor element 6 is positioned such that its center line is located at the intersection of the center lines of receptacle mating openings 4 and 5, the conductor element 6 being further provided with a blade portion 8 extending into the receptacle passageway 3 and a termination portion 9. Outer conductor body 2 may also be provided with a tapered portion 10.

Figure 3:
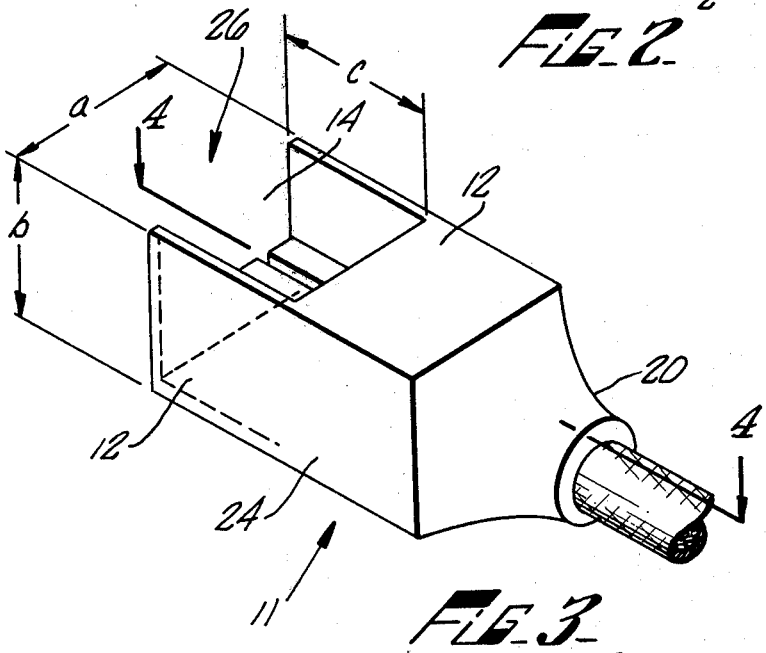
FIG. 3 is a perspective view of a connector plug which has been terminated to a coaxial cable.
Figure 4:
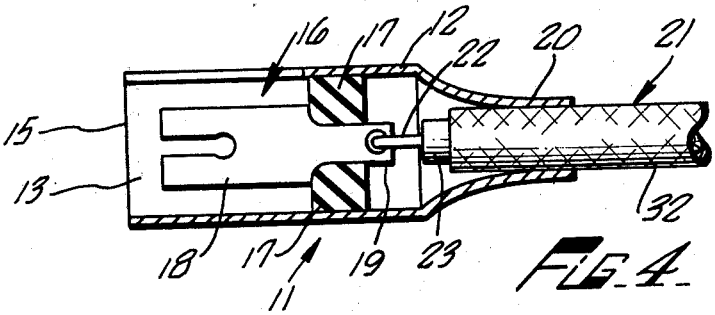
FIG. 4 is a cross-sectional view taken along lines 4—4 of FIG. 3.

Referring now particularly to FIGS. 3 and 4 a connector plug 11 is shown having a plug outer conductor body 12 forming a passageway 13 therein. The plug body 12 is provided with a first plug body mating opening 14, and a second plug body mating opening 15, both mating openings 14 and 15 being in communication with the plug passage 13. The mating openings 14 and 15 may be approximately the same size and shape. The openings 14 and 15 lie in perpendicular planes and have perpendicular center lines. A mating section 26 of the plug body 12 which defines the mating openings 14 and 15 has an external shape substantially similar to and either the same size or slightly smaller than the receptacle mating openings 4 and 5 of receptacle body 2. In a preferred embodiment as shown in FIG. 3, the mating section 26 of the plug body 12 defining the mating openings 14 and 15 is rectangular in shape having external dimensions *a* and *b*. Openings 14 and 15 are smaller than openings 4 and 5, as shown in FIG. 3, the dimension *c* being less than or equal to dimension *b*.

Located within the plug body 12 is a plug inner conductor element 16 which is separated from the plug body by a dielectric material 17. In a preferred embodiment the plug conductor element 16 is positioned such that its center line is located at the intersection of the center lines of plug mating openings 14 and 15. The plug conductor element 16 may be further provided with a fork or bifurcated tine portion 18 and a coaxial cable termination portion 19; the plug body 12 being further provided with a tapered portion 20 as to position coaxial cable 21 into the passageway 13 of the plug body 2. The coaxial cable 21 is shown as comprising a central conductor portion 22 which is terminated to the termination portion 19 of the inner plug conductor 16, the central conductor portion 22 being enclosed within a dielectric tube 23, which in turn is surrounded by a concentric conductive sheath 32, the sheath 32 being in electrical and mechanical contact with the tapered portion 20 of the plug body 12. A protective tubular cover (not shown) may be employed to encricle the conductive sheath 32 and further protect the coaxial cable 21. While the termination of a coaxial cable 21 to the connector plug 11 and the connector receptacle 1 may be accomplished by a variety of means, the preferred method of termination is set out in U.S. Pat. No. 3,541,495 issued to Ellis and Grafton Nov. 17, 1970.

Figure 5:
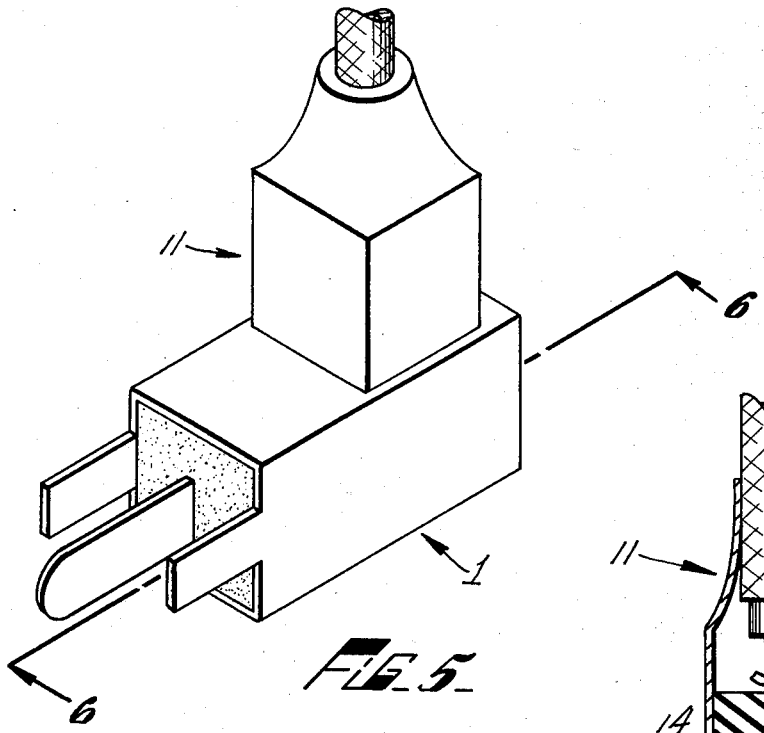
FIG. 5 is a perspective view of the receptacle connector, configured for attachment to a printed circuit board, and plug connector in a right angle mating position.
Figure 6:
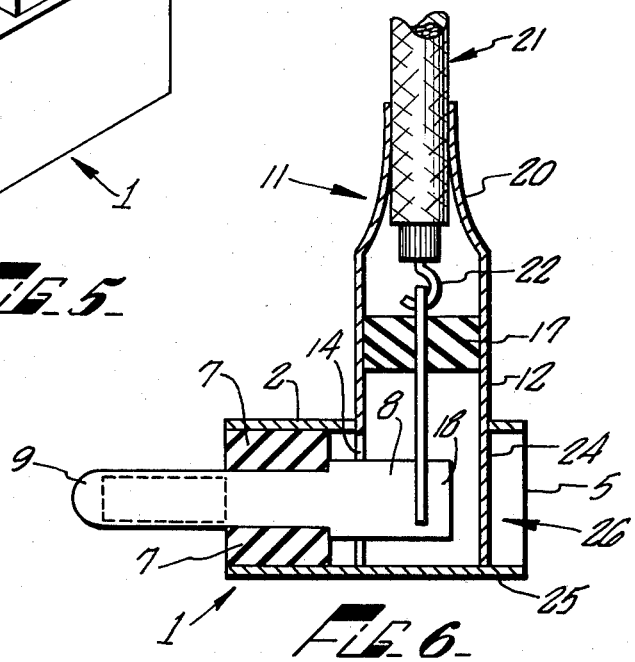
FIG. 6 is a cross-sectional view taken along lines 6—6 of FIG. 5.
Figure 9:
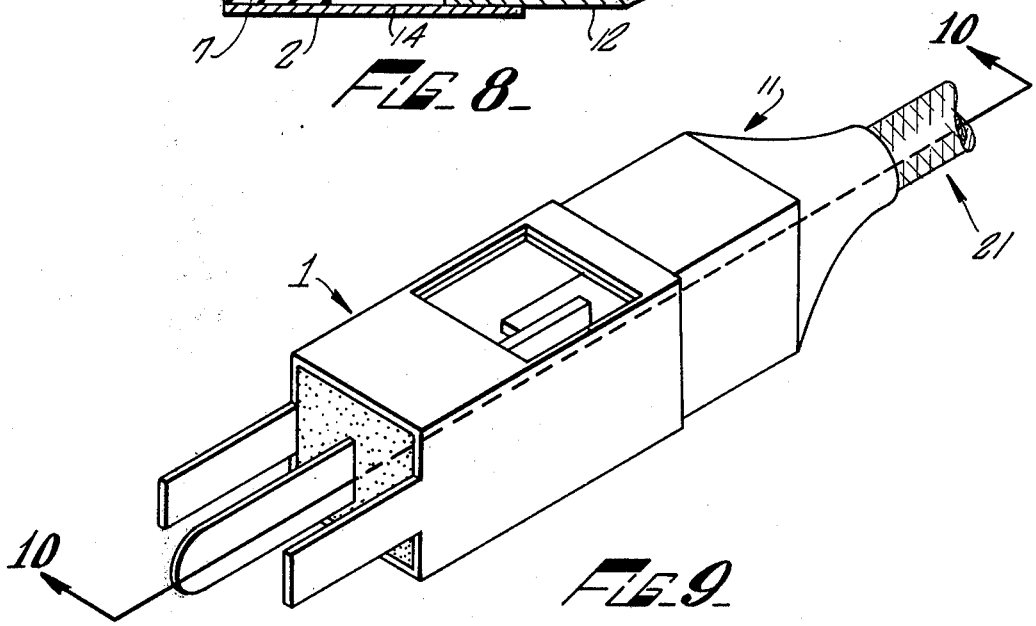
FIG. 9 is a perspective view of the receptacle connector and plug connector in a straight mating position which allows for test probe access.
Figure 10:
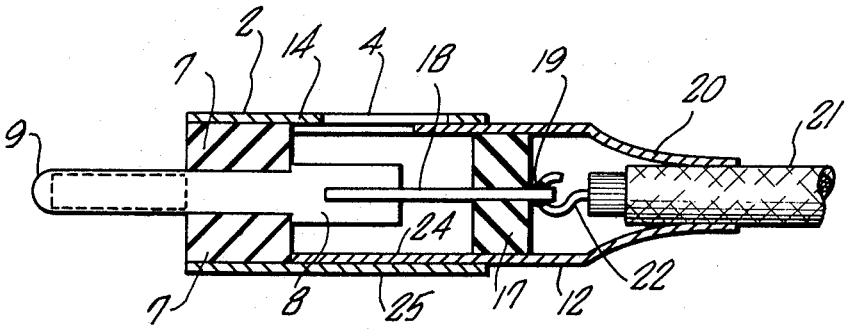
FIG. 10 is a cross-sectional view taken along lines 10—10 of FIG. 9.
Figure 11:
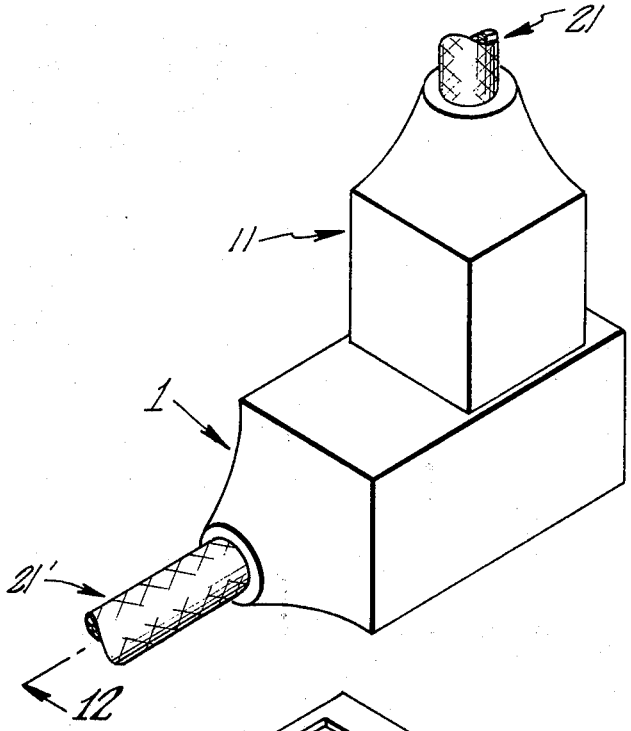
FIG. 11 is a perspective view of right angle connection of a plug connector and receptacle connector both having been terminated to a coaxial cable.
Figure 12:
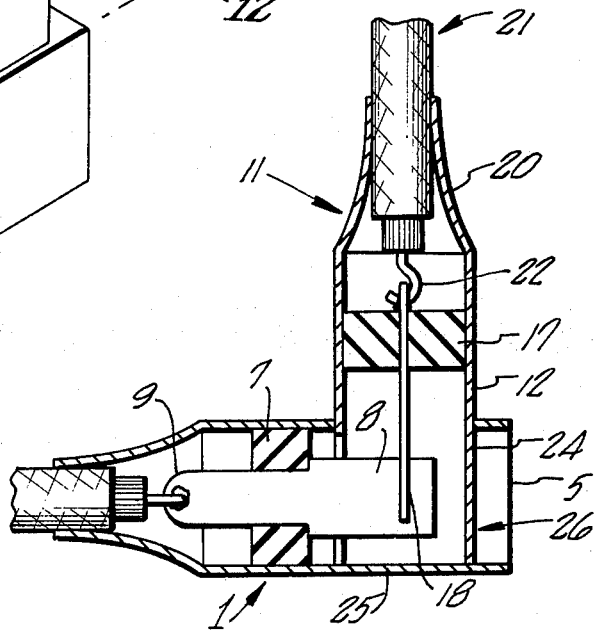
FIG. 12 is a cross-sectional view taken along lines 12—12 of FIG. 11.

Having defined the connector receptacle 1 and the connector plug 11 in detail, the function of their various elements may be more fully understood by referring to FIGS. 5–12 where the connector receptacle 1 and connector plug 11 are shown in preferred embodiment mating positions. FIGS. 5, 6, 11 and 12 show the plug 11 and receptacle 1 connected so as to form a right angle connection. In FIGS. 5 and 6 the receptacle is shown to be adapted for termination into a printed circuit board or the like. In FIGS. 11 and 12, both the plug 11 and receptacle 1 are shown to be terminated to coaxial cables. As the mating portion 26 of the plug body 12 has dimensions equal to or slightly less than the receptacle mating openings 4 and 5, when the plug mating portion 26 is inserted in the mating opening 4 thereby effecting a right angle connection, the receptacle conductor body 2 and plug conductor body 12 are placed in mechanical and electrical contact. Similarly, the blade member 8 of the receptacle inner conductor 16 are shown to be engaged and in mechanical anad electrical contact. A shielding portion 24 of the plug body 12 which is located opposite mating opening 14 of the plug 11 is shown to shield the connection by covering the mating opening 5 of the receptacle 1. Similarly, a shielding portion 25 of the receptacle body 2 which is located opposite mating opening 4 of the receptacle body 1 is shown to shield the connection by covering the mating opening 15 of the plug 2. It may be noted that the plug 11 and receptacle 1 cannot be connected in an unshielded position, as if the plug were rotated 180° so as to allow for the engagement of the fork member 18 and the blade 8, shielding portion 24 of the plug 11 would strike the blade member 18 thus preventing a connection. At this juncture it may be seen why plug mating opening 14 is to be smaller than receptacle mating openings 4 and 5, for were the *c* dimension of plug mating opening 14 larger than the *b* dimension, the opening 14 would not be shielded by the body 2 of the receptacle 1.

Figure 7:
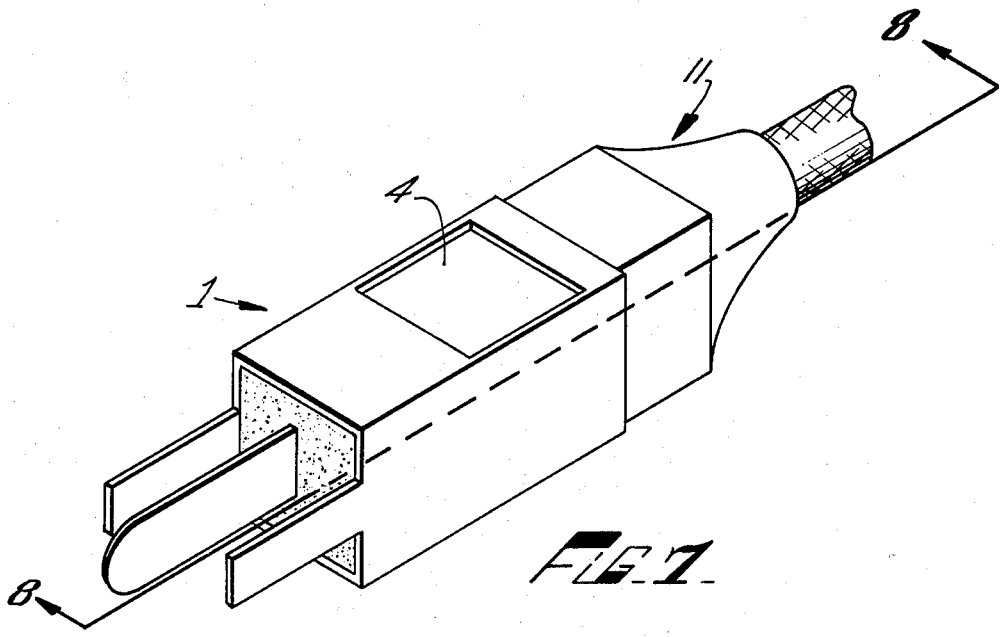
FIG. 7 is a perspective view of the receptacle connector and plug connector in a straight, fully shielded, mating position.
Figure 8:
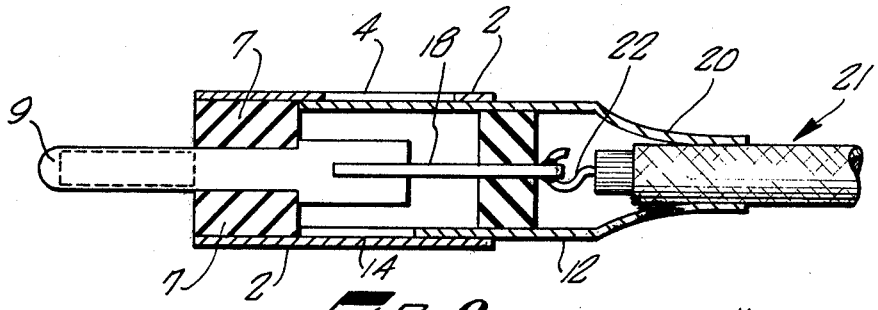
FIG. 8 is a cross-sectional view taken along lines 8—8 of FIG. 7.

FIG. 7–10 illustrate the plug 11 and receptacle 1 joined in "straight" connections, FIGS. 9–10 illustrating a fully shielded straight connection, and FIGS. 9–10 showing a straight connection providing test probe access.

Referring now to FIG. 7 and 8, the plug mating portion 26 of the plug 11 is shown inserted through mating opening 5 of the receptacle 1 such that the shielding portion 24 of the plug 11 covers the receptacle mating opening 4. FIGS. 9–10 illustrate the insertion ofthe plug 11 into the receptacle 1, the plug having been rotated 180° from the position shown in FIGS. 7–8, such that the shielding portion 24 of the plug 11 is adjacent the shielding portion 25 of receptacle 1, and the mating opening 14 of the plug 11 is adjacent the mating opening 4 of the receptacle thereby providing test probe access to the connection between the plug inner conductor 16 and the receptacle inner conductor 6. If this test probe access feature is not desired, such engagement can be prevented by any of a variety of conventional keying means. Similarly a variety of latching and/or detenting features may be added to hold the connector halves 1 and 11 in engagement and to further enhance the electrical connection between their outer bodies 2 and 12 respectively. It is further understood that the geometry of the connector halves 1 and 11 is such that their impedance may be matched to the cable to be connected.

Figure 13:
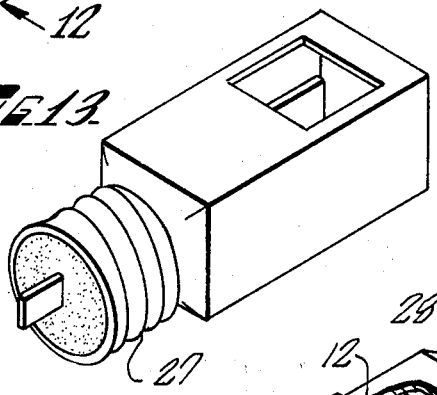
FIG. 13 is a perspective view of a threaded receptacle connector.
Figure 14:
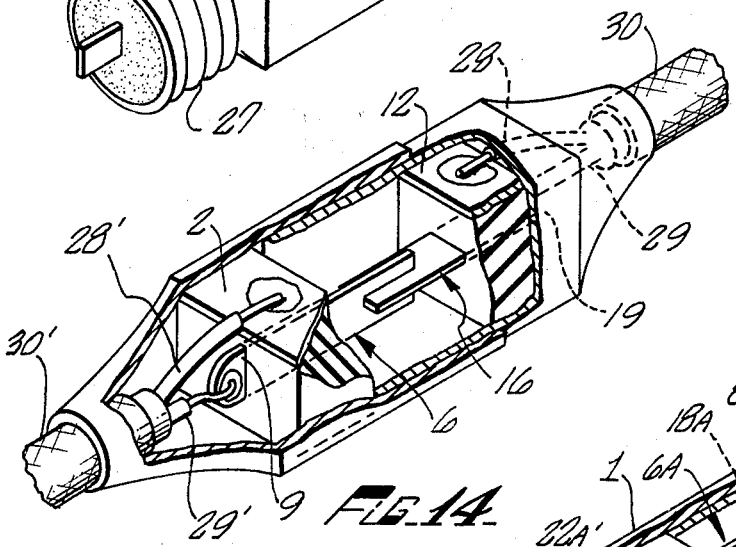
FIG. 14 is a partially broken away perspective view of a straight connection of a plug connector and a receptacle connector, both having been terminated to a pair of electrical conductors.
Figure 15:
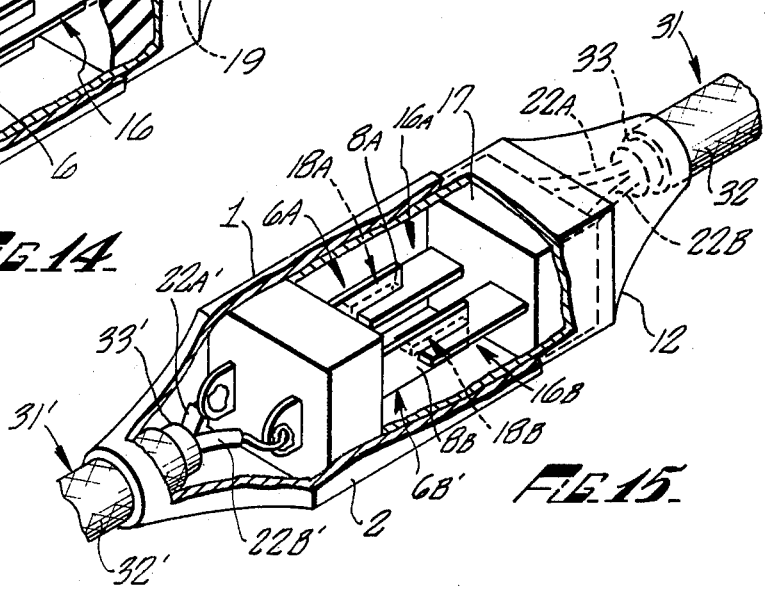
FIG. 15 is a partially broken away perspective view of a straight connection of a plug connector and a receptacle connector both having been terminated to a shielded pair type cable having two inner conductors.

FIG. 13 illustrates the receptacle outer body 2 being provided with threads 27 as for mounting to a bulk head or the like. The foregoing discussion has been directed to a connection for coaxial cables having an outer conductor and an inner conductor separated by a dielectric. FIGS. 14 and 15 illustrate two other important embodiments of this invention. In FIG. 14 a modification of the invention is shown wherein a pair of electrically conductive wires 28 and 29 contained within an insulation covering 30 are terminated to the plug connector 11 and electrically conductive wires 28' and 29' contained within an insulation covering 30' are terminated to the receptacle connector 1. The wire 29, is shown terminated to the termination portion 19 of the plug inner conductor 16 and wire 29' is shown terminated to the termination portion 9 of the receptacle inner conductor 6. Wire 28 is shown terminated to the plug body 12, and wire 28' is shown terminated to the receptacle body 2. The preferred method of termination is described in U.S. Pat. No. 3,541,495 issued to Ellis and Grafton for twisted pair wire as well as coaxial or belted cable.

Referring now to FIG. 15, the connection of two shielded pair cables 31 and 31' is shown. In FIG. 15 the cable 31 contains a pair of inner conductors 22A and 22B each insulated from each other and from an outer conductive sheath 32 by a dielectric 33. The plug body 12 is now provided with two inner conductor elements 16A and 16B, insulated from each other and the plug body 2 by the dielectric 17, to which the two inner conductors 22A and 22B of the shielded pair cable may be terminated. In this embodiment the receptacle body 1 is also provided with two inner condcutors 6A and 6B to which the inner conductors 22A' and 22B' of a second shielded pair cable 31' may be terminated. The inner conductors 22A' and 22B' are insulated from each other and from an outer conductive sheath 32' by a dielectric 33'. Each of the inner plug conductors 16A and 16B may be equipped with a forked portion 18A and 18B respectively which may be to engaged blade portions 8A and 8B of the inner receptacle conductors 6A and 6B.

Figure 16:
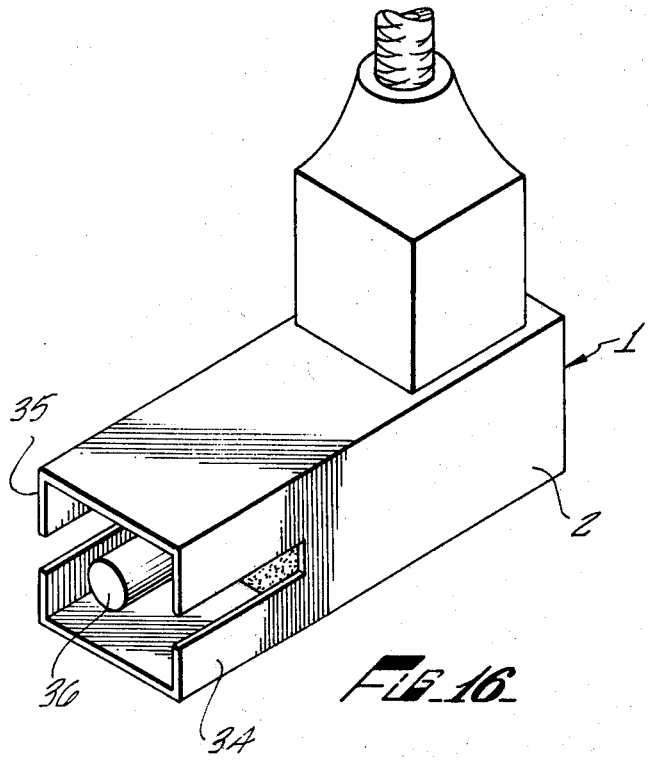
FIG. 16 is a perspective view like FIG. 11 wherein the receptacle connector has been modified.
Figure 18:
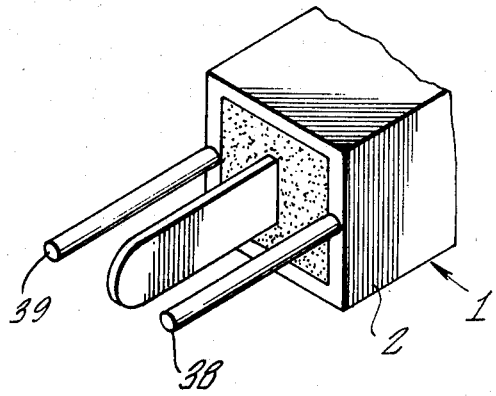
FIG. 18 is a partial perspective like FIG. 16 wherein the receptacle connector has yet another modification.
Figure 17:
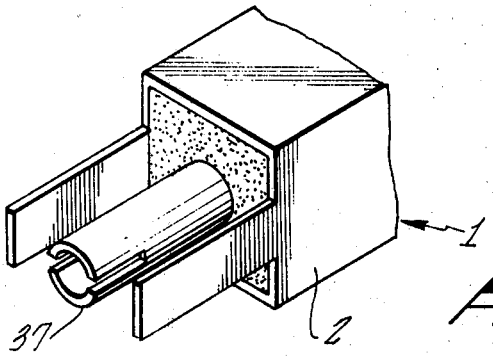
FIG. 17 is a partial perspective like FIG. 16 wherein the receptacle connector has another modification.

FIGS. 16–18 illustrate various ways in which the connector receptacle 1 and connector plug 12 can be modified to provide a vairety of terminations. Referring to FIG. 16, the receptacle outer body 2 is shown terminating in a socket contact comprising slotted walls 34 and 35. In FIG. 16, the inner conductor element is shown terminating as a pin contact 36.

FIG. 17 shows a variation of an end structure for connector receptacle 1 in which the inner conductor element terminates in a socket contact 37 comprising a hollow slotted cylinder.

FIG. 18 depicts a variation of receptacle outer body 2 in which it is provided with a pair of pin connectors 38 and 39.

Although the various terminations shown in, for example, FIGS. 9, 13 and 16–18 have been illustrated with respect to the connector receptacle, it will be apparent to those skilled in the art that similar modifications can be made to the connector plug itself.

Having fully described my invention, it is to be understood that I am not to be limited to the details herein set forth but that my invention is of the full scope of the appended claims.

I claim:

1. A device for connecting electrical conductors comprising:

a connector receptacle having a receptacle outer conductor body forming a receptacle passageway therein, said rectpacle body having first and second openings therein communicating with said receptacle passageway; said openings being of substantially the same size, lying in perpendicular planes and having perpendicular center lines, and at least one receptacle inner conductor element positioned within said receptacle body passageway, said receptacle inner conductor element being separated from said receptacle body by a dielectric, said receptacle inner conductor element being accessible through said first or second openings; and a connector plug having a plug outer conductor body forming a plug passageway therein, said plug body having first and second openings therein communicating with said plug passageway, said first and second plug body openings being smaller than said first and second receptacle body openings, lying in perpendicular planes and having perpendicular center lines, at least that portion of said plug body having said plug body openings being slightly smaller than, and of a shape substantially similar to, said receptacle body openings in order that said plug body can be inserted into one of said first or second openings in said receptacle body, thereby allowing for the total shielding of said receptacle and plug inner conductors; and at least one plug inner conductor element positioned within said plug body passageway, said inner plug conductor element being separated from said plug body by a dielectric and adapted to make mechanical and electrical contact with the receptacle inner conductor element when the connector plug is inserted into the connector receptacle, said plug inner conductor element being accessible through said first or second plug body openings.

2. The device as claimed in claim 1 wherein said receptacle openings and said plug openings are rectangular.

3. The device as claimed in claim 1 wherein said receptacle openings and said plug openings are square.

4. The device as claimed in claim 1 wherein one end of said receptacle inner conductor element extends into said receptacle body passageway and toward said first receptacle opening located at one end of said receptacle.

5. The device as claimed in claim 4 wherein said plug inner conductor element extends into said plug passageway and toward said first plug mating opening located at one end of said plug.

6. The device as claimed in claim 5 wherein said connector plug outer conductor body is tapered to position a coaxial cable within said plug body, said plug body taper having substantially the same centerline as said plug inner conductor and being circumferential about the end of said plug inner conductor opposite said plug inner conductor extension into said plug passageway; and said connector receptacle outer conductor body being tapered to guide a coaxial cable into said receptacle body, said receptacle body taper having substantially the same centerline as said receptacle inner conductor and being substantially circumferential about the end of said receptacle inner conductor opposite said receptacle inner conductor extension into said receptacle passageway.

7. The device as claimed in claim 5 wherein said connector plug outer conductor body is shaped to position a pair of insulated twisted wires within said plug body, said plug body being substantially circumferential about the end of said plug inner conductor opposite said plug inner conductor extension into said plug passageway; and said connector receptacle outer conductor body being shaped to position a pair of insulated twisted wires into said receptacle body, said receptacle body being circumferential about the end of said receptacle inner conductor opposite said receptacle inner conductor extension into said receptacle passageway.

8. The device as claimed in claim 5 wherein said connector plug outer conductor body is shaped to position a shielded multiconductor cable into said plug body, said plug body shape having substantially the same centerline as said plug inner conductors and being circumferential about the end of said plug inner conductor extensions into said plug passageway; and said connector receptacle outer conductor body being shaped to position a shielded multiconductor cable into said receptacle body, said receptacle body taper having substantially the same centerline as said receptacle inner conductors and being circumferential about the ends of said receptacle inner conductors opposite said receptacle inner conductor extensions into said receptacle passageway.

9. A device for connecting coaxial cables having an inner conductor and an outer conductor separated by a dielectric comprising:

a receptacle connector having a receptacle outer conductor body forming a receptacle passageway therein, said receptacle body having an end opening and a side opening therein communicating with said receptacle passageway, each opening having a predetermined depth; said end and side openings being of substantially the same size, lying in perpendicular planes and having perpendicular center lines; and at least one receptacle inner conductor element positioned within said receptacle body passageway, said receptacle inner conductor being separated from said receptacle body by a dielectric, said receptacle inner conductor element being accessible through first or second receptacle openings, and one end of said receptacle inner conductor extending into said receptacle passageway and toward one end of said receptacle body;

a plug connector having a plug outer conductor body forming a plug passageway therein, said plug body having an end opening and a side opening therein communicating with said plug passageway, said end and side openings being smaller than said receptacle end opening and said side opening, lying in perpendicular planes and having perpendicular centerlines, at least that portion of said plug body adjacent to and defining having said plug body openings being slightly smaller than, and of a shape substantially similar to, said receptacle body openings in order that said plug body can be inserted into one of said end or side openings, the distance of all portions of said plug body side opening from said end of said plug body defining said plug body openings being less than said depth of said receptacle body openings; and at least one plug inner conductor element positioned wiithin said plug body passageway, said plug inner conductor being separated from said plug body by a dielectric and adapted to make mechanical and electrical contact with the receptacle inner conductor element when the connector plug is inserted into the connector receptacle, said plug inner conductor element being accessible through said first or second plug openings, and one end of said plug inner conductor extending into said plug passageway and toward one end of said plug body.

10. The device as claimed in claim 9 wherein the other end of said plug body is tapered to position a coaxial cable within said plug body.

11. The device claimed in claim 9 wherein the other end of said receptacle is tapered to position a coaxial cable within said receptacle body.

12. The device as claimed in claim 9 wherein the other end of said receptacle body terminates in a socket contact.

13. The device as claimed in claim 9 wherein the other end of said receptacle inner conductor element terminates in a pin contact.

14. The device as claimed in claim 9 wherein the other end of said receptacle body terminates in at least one pin connector.

15. The device as claimed in claim 9 wherein the other end of said receptacle inner conductor element terminates in a socket contact.

16. The device as claimed in claim 9 wherein the other end of said connector receptacle body has an externally threaded contact.

17. The device as claimed in claim 9 wherein said receptacle inner conductor element extension terminates in a blade.

18. The device as claimed in claim 9 wherein said plug inner conductor extension terminates in a bifurcated tine.

19. The device as claimed in claim 9 wherein the other end of said plug body terminates in a socket contact.

20. The device as claimed in claim 9 wherein the other end of said plug inner conductor element terminates in a pin contact.

21. The device as claimed in claim 9 wherein the other end of said plug body terminates in at least one pin connector.

22. The device as claimed in claim 9 wherein the other end of said plug inner conductor element terminates in a socket contact.

23. The device as claimed in claim 9 wherein the other end of said connector plug body has an externally threaded contact.

24. The device as claimed in claim 9 wherein said plug inner conductor element extension terminates in a blade.

25. The device as claimed in claim 9 wherein said receptacle inner conductor extension terminates in a bifurcated tine.

26. A device for connecting electrical conductors having an inner conductor and an outer conductor separated by a dielectric comprising:

a connector receptacle having a receptacle outer conductor body forming a receptacle passageway therein, said receptacle body having first and second openings therein communicating with said receptacle passageway; said first and second openings being of substantially the same size, lying in perpendicular planes and having perpendicular center lines;

at least one insulated receptacle inner conductor element positioned within said receptacle body passageway, said receptacle inner conductor being separated from said receptacle body by a dielectric, said receptacle inner conductor element being accessible through said first or second receptacle body mating openings;

a connector plug having a plug outer conductor forming a plug passageway therein, said plug body having first and second openings therein communicating with said plug passageway, said first and second openings of said plug body being smaller than said first and second receptacle openings, lying in perpendicular planes and having perpendicular centerlines; and at least one insulated plug inner conductor element positioned within said plug body passageway, said plug inner conductor being separated from said plug body by a dielectric, said plug inner conductor communicating with said first or second openings, wherein said plug inner connector is adapted such that when the plug body adjacent to and defining said plug openings is inserted into one of said receptacle body openings, thereby bringing said plug outer conductor body and said receptacle outer conductor body into mechanical and electrical contact, said inner plug conductor is placed in mechanical and electrical engagement with said inner receptacle conductor.

* * * * *